US005736491A

United States Patent [19]

Patel et al.

[11] Patent Number: 5,736,491

[45] Date of Patent: Apr. 7, 1998

[54] METHOD OF IMPROVING THE FUEL ECONOMY CHARACTERISTICS OF A LUBRICANT BY FRICTION REDUCTION AND COMPOSITIONS USEFUL THEREIN

[75] Inventors: Jitendra A. Patel; Arthur J. Stipanovic, both of Wappingers Falls; Jeffrey P. Schoonmaker, Wallkill, all of N.Y.

[73] Assignee: Texaco Inc., White Plains, N.Y.

[21] Appl. No.: 790,420

[22] Filed: Jan. 30, 1997

[51] Int. Cl.[6] ..... C10M 141/02; C10M 141/12

[52] U.S. Cl. ..... 508/365; 508/378

[58] Field of Search ..... 508/365, 378, 508/539

[56] References Cited

U.S. PATENT DOCUMENTS

| | | | |
|---|---|---|---|
| 3,595,891 | 7/1971 | Cavitt | 556/44 |
| 4,308,154 | 12/1981 | Clason et al. | 508/378 |
| 4,633,001 | 12/1986 | Cells | 556/44 |
| 4,824,611 | 4/1989 | Cells | 556/44 |
| 4,978,464 | 12/1990 | Coyle et al. | 252/42.7 |
| 5,019,283 | 5/1991 | Beltzer et al. | 252/33.6 |
| 5,137,647 | 8/1992 | Karol | 252/33.6 |
| 5,266,225 | 11/1993 | Hall et al. | 252/32.7 |
| 5,364,545 | 11/1994 | Arai et al. | 508/365 |

OTHER PUBLICATIONS

Stipanovic et al., "The Impact of Base Oil Composition on the Friction Reducing Mechanism of Organomolybdenum Compounds in Engine Oil Applications", Proceedings of the International Tribology Conference, Yokohama 1995 Month unavailable.

Lexis Search Report, Aug. 30, 1996.

Overhead Projections Used at Meeting of International Triblogy, Yokohama, Japan, Oct. 31, 1995.

*Primary Examiner*—Jacqueline V. Howard

*Attorney, Agent, or Firm*—Henry H. Gibson; Arnold, White & Durkee

[57] ABSTRACT

A method of improving the fuel economy characteristic of a lubricant by friction reduction including mixing the lubricant with a $C_2$ to $C_{12}$ aliphatic carboxylate salt of molybdenum and a zinc dialkyldithiophosphate or zinc dialkyldithiocarbamate is disclosed. The synergistic interaction of the aliphatic carboxylate salt of molybdenum and the zinc salt results in at least a 30% reduction in the coefficient of friction at 100° C.

22 Claims, 3 Drawing Sheets

METHOD OF IMPROVING THE FUEL ECONOMY CHARACTERISTICS OF A LUBRICANT BY FRICTION REDUCTION AND COMPOSITIONS USEFUL THEREIN

BACKGROUND OF THE INVENTION

1. Field of the Invention

The present invention is generally directed to the use and formulation of energy conserving lubricants, in particular engine oils and differential or transaxle lubricants or oils.

2. Background Information

Energy saving lubricants are used by automobile manufacturers to meet Federal CAFE regulations requiring a specified average fuel economy. As a general figure, approximately 10% of the total energy in a gallon of gasoline is lost due to internal friction in the crank case, the pistons and piston rings, the main bearings, the cam shaft and the valve lifters, the differential gears and so forth.

There are several ways to reduce the friction in engines and drivetrains and thus improve fuel economy. One way is to optimize the viscometric properties of the lubricant so that it flows between metal parts more easily. By using this approach, a greater amount of the lubricant is more easily circulated into areas of high friction. Another approach is to formulate energy saving lubricants so as to include additives, which in conjunction with the hydrocarbon or other oil components, decrease the frictional forces between the metal parts thus reducing fuel consumption. Typically called friction modifiers, these chemical agents adsorb to the surface of the metal part at high temperature and pressure and form a molecular lubricating layer. It should be apparent to one of ordinary skill in the art that these friction modifying compounds need to be at least partially soluble in the base oil mixture.

One class of friction modifier includes long chain hydrocarbon fatty acids such as steric or oleic acid. It is believed that these compounds enhance engine lubrication by bonding via the carboxylate group to the metal surface.

Another class of friction modifier includes molybdenum or vanadium complexes, and in particular the metal dithiocarbamate and thiophosphate metal complexes. This class of compounds are known to work especially well under conditions of high temperature and high pressure or load on the engine. It is believed that these compounds form molecularly thin metal sulfide layers on the surfaces of the metal parts and it is this that reduces the coefficient of friction. These compounds are commercially available under the trademark SAKURALUBE (TM) (Asahi Denka Kogyo, Japan), which is a proprietary lubricant additive including a molybdenum dithiocarbamate complex, and MOLYVAN (TM), which is a proprietary lubricant additive including molybdenum dithiocarbamate available from Vanderbilt, Inc.

A third class of friction modifier includes the carboxylic acid salts of several transition metals the synthesis of which is described in U.S. Pat. Nos. 4,633,001 and 4,824,611. In particular several different carboxylic acid salts of molybdenum and vanadium are disclosed. One disclosed use of these compounds includes the use as a additive in lubricant formulations. Specific examples of lubricant formulations are given utilizing vanadium 2-ethylhexanoate in mineral oils and synthetic oils. Other uses for these compounds include the use as accelerators for polyester resins, and drying agents for paint and ink formulations. U.S. Pat. No. 3,595,891 also discloses a process for synthesizing organic transitions metal salts, in particular carboxylate salts of molybdenum and vanadium, which are useful as catalysts for the epoxidation of olefins, as lubricant additives, or as metal plating agents.

SUMMARY OF THE INVENTION

The present invention is generally directed to a method of improving the fuel economy characteristics of a lubricant by friction reduction including mixing the lubricant with a $C_2$ to $C_{12}$ aliphatic carboxylate salt of molybdenum and a zinc dialkyldithiophosphate. Alternatively a zinc dialkyldithiocarbamate may be used instead of the zinc dialkyldithiophosphate. The alkyl groups of the zinc dialkyldithiophosphate or dialkylthiocarbamate may be selected so that the zinc salt exchanges ligands with the molybdenum salt. In one embodiment the alkyl group may be a $C_2$ to $C_8$ aliphatic hydrocarbon. In another embodiment the alkyl group is isopropyl, $C_6$ alkyl, $C_7$ alkyl and mixtures thereof. The aliphatic carboxylate salt of molybdenum is present in the lubricating composition in an amount between about 0.25% and about 10% by weight. In one embodiment the aliphatic carboxylate is 2-ethylhexanoate.

Another aspect of the present invention are the lubricating oil compositions made by the above method. Experimental data indicates that unexpected synergistic interactions occurs between the aliphatic carboxylate of molybdenum and the zinc dialkyl dithiophoshphate. It is believed that this synergistic interaction results in the observed reduction in the coefficient of friction. The unexpected result of this synergistic interaction is the reduction of the coefficient of friction of the lubricating composition by at least about 30% at 100° C. Spectroscopic data indicate that a ligand exchange reaction occurs between the aliphatic carboxylate of molybdenum and the zinc dialkyl dithiophosphate and it is speculated that this is the source of the friction reduction capabilities of the lubricating compositions of the present invention. In one composition embodiment the dialkyldithiophosphate is replaced by dialkyldithiocarbamate.

BRIEF DESCRIPTION OF THE DRAWINGS

These and other features of the present invention are more fully set forth in the following description of illustrative embodiments of the invention. The description is presented with reference to the accompanying drawings in which.

DETAILED DESCRIPTION OF THE INVENTION

Figure 1:
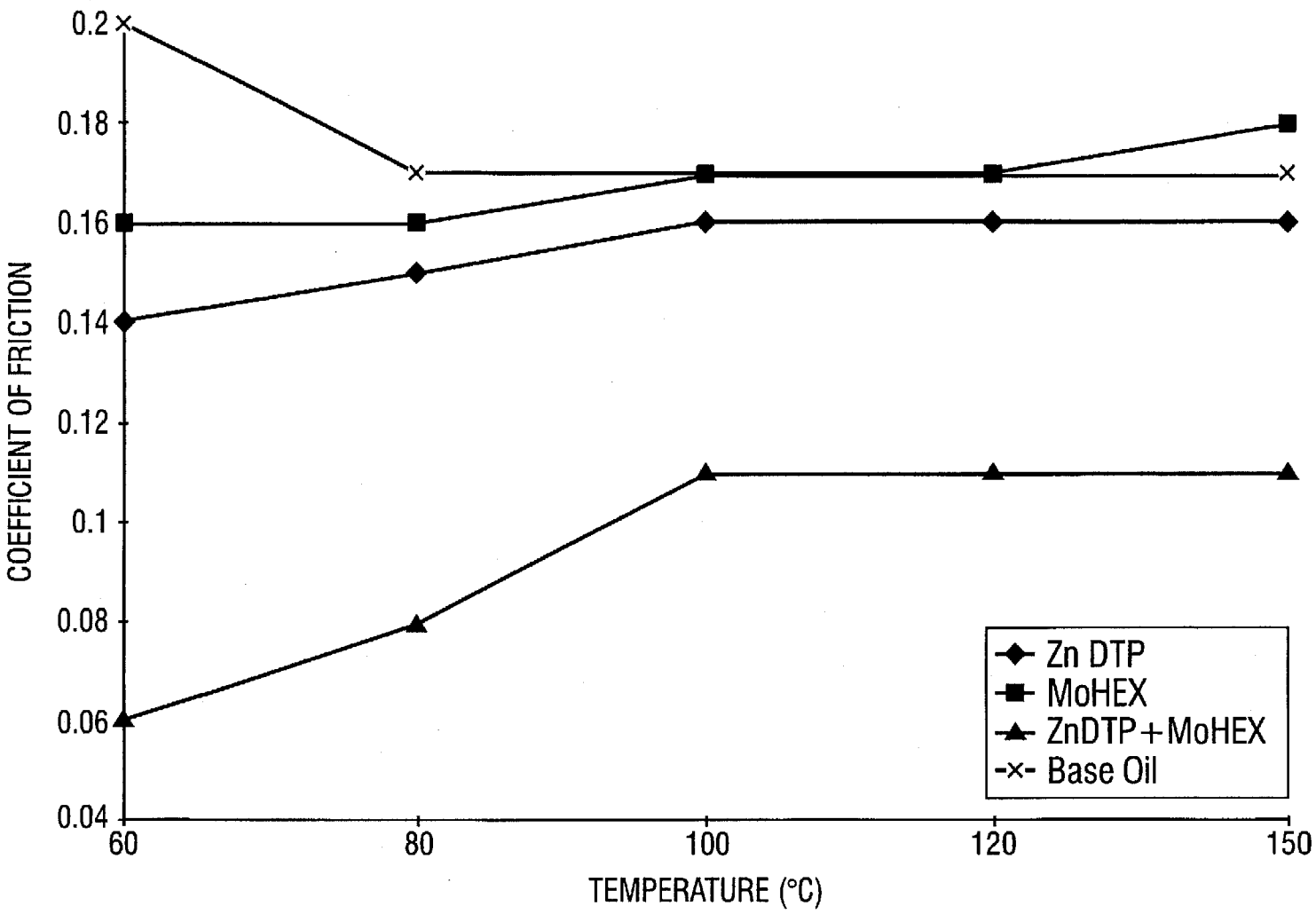
FIG. 1 is a graphical representation of data showing the effect of temperature on the coefficient of friction for various lubricating compositions.

As previously noted, the present invention is generally directed to a method of improving the fuel economy characteristics of lubricant compositions. One of ordinary skill in the art should appreciate and understand that although the following discussion focuses on gasoline engine oil, other lubricant compositions such as diesel engine oil, differential or transaxle oils and greases, transmission fluids and the like can be formulated so as to improve their fuel economy characteristics given the present disclosure. Thus such alternative embodiments are considered to be within the scope of the present invention.

The process for making the additives of the present invention should be known to and appreciated by one of ordinary skill in the art given the present disclosure. Methods of making the molybdenum carboxylate salts used herein are disclosed in U.S. Pat. Nos. 4,824,611, 4,633,001 and 3,595,891 the contents of which are hereby incorporated herein by reference. Suitable examples of the molybdenum carboxylate salts used herein are commercially available and are sold under the trademark HEXCHEM(TM) by Mooney Chemicals, Inc. of Cleveland, Ohio. The zinc dialkyldithiophosphate compounds used in the present invention readily available commercially and are typically used as antioxidants. Suitable examples of the zinc dialkyldithiophosphate used herein are commercially available under the trademarks, LUBRIZOL (TM) or ETHYL (TM).

The lubricant compositions of the present invention are prepared by mixing the additives and the base lubricating composition in suitable blending equipment, using conventional techniques. The mixing may be conducted at room temperature or at elevated temperatures if the viscosity of the base lubricating composition so dictates. The particular base lubricating composition is selected on the basis of its contemplated application and may contain other conventional additives in amounts sufficient to fulfill each additive's purpose. Such conventional additives may include oxidation inhibitors, dispersants, detergents, viscosity improvers, rust inhibitors, anti-foam agents, stabilizers, extreme pressure agents and the like. Examples of such compounds should be apparent to one of ordinary skill in the art. As used herein, lubricating compositions in which conventional additives have been mixed are referred to as being "fully formulated".

Lubricating compositions of one embodiment of the present invention include engine oils in which a major amount of any of the well-known types of oils of lubricating viscosity ranging from 50 to 5000 SUS at 38° C. are considered as suitable base oils. These include hydrocarbon or mineral lubricating oils of naphthenic, paraffinic, and mixed naphthenic and paraffinic types. The oils may be refined by conventional methods such as solvent refining, dewaxing and hy-finishing or through hydrocracking. Synthetic hydrocarbon oils of the alkylene polymer type or those derived from coal and shale may also be employed. Alkylene oxide polymers and their derivatives such as the propylene oxide polymers and their ethers and esters in which the terminal hydroxyl groups have been modified are also suitable. Synthetic oils of the dicarboxylic acid ester type including dibutyl adipate, di-2-ethylhexyl sebacate, di-n-hydroxyl fumaric polymer, di-lauryl azelate, and the like may be used. Alkyl benzene types of synthetic oils such as tetradecyl benzene, etc., also can be used.

It is conventional to use zinc dialkyldithiophosphate compounds in the formulation of lubricating compositions. Conventionally these compounds are used in the formulation of oils as anti-wear agents and antioxidant agents. The anti-wear agents of the prior art are generally believed to exert a 'cushioning effect' between moving metallic parts of an engine. One of ordinary skill in the art should appreciate and understand that the friction-reducing concept of the present invention is totally different from a purely anti-wear effect and the two are not synonymous. In fact, there are data available which clearly demonstrate that a zinc dialkyldithiophosphate (the most common type of anti-wear agent) can actually cause an increase in friction when added to an oil formulation.

As noted above, it is also known to use carboxylate salts of molybdenum as an additive to lubricating compositions. In such applications it is believed that the role of the compound is to provide a ready source of molybdenum for the formation of molecular layers of molybdenum sulfide on the metal surfaces. One of ordinary skill in the art should know and appreciate that the beneficial effects of these compounds are achieved only under conditions of relatively high surface contact temperature, that is greater than 100° C.

In order to achieve the unexpected results of the present invention, one should formulate the lubricating composition, engine oil as in the case of the present illustrative embodiment, so as to include a $C_2$ to $C_{12}$ aliphatic carboxylate salt of molybdenum and a zinc dialkyldithiophosphate or zinc dialkyldithiocarbamate. In one embodiment the aliphatic carboxylate group is selected from the group including 2-ethylhexanoate, heptanoate, decanoate, dodecanoate and mixtures thereof. In a preferred embodiment the aliphatic carboxylate group is 2-ethylhexanoate. The alkyl group of the zinc dialkyldithiophosphate or dialkyldithiocarbamate should be selected so that the dialkyldithiophosphate or dialkyldithiocarbamate exchanges with the ligands of the molybdenum salt. The length of the alkyl group has been found to be important in achieving this desired result in that the alkyl group of the dialkyldithiophosphate or dialkyldithiocarbamate should be a $C_2$ to $C_8$ aliphatic hydrocarbon. In one embodiment, the aliphatic hydrocarbon is selected from the group including ethyl, propyl, isopropyl, sec-butyl, tert-butyl, isomers of pentyl, methylpentyl, dimethylpentyl, trimethylopentyl, ethylpentyl, ethylmethylpentyl, hexyl, methylhexyl, dimethylhexyl, ethylhexyl and mixtures thereof. In one embodiment the aliphatic hydrocarbon is isopropyl. In another embodiment a mixture of isopropyl and minor amounts of the isomers of C6 and C7 alkyls are used. As will be shown below, it is the unexpected synergistic interaction of the $C_2$ to $C_{12}$ aliphatic carboxylate salt of molybdenum and the zinc dialkyldithiophosphate that results in the reduced coefficient of friction and thus the increase in the fuel economy characteristics of the present invention. Further, this effect is achieved at temperatures significantly lower than expected or achieved by the compounds separately.

Generally the mount of the additives of the present invention used in the lubricating composition should result in a reduction in the coefficient of friction, especially at lower temperatures, thus resulting in the improvement of the fuel economy characteristics. In one embodiment of the present invention, the amount of $C_2$ to $C_{12}$ aliphatic carboxylate salt of molybdenum and a zinc dialkyldithiophosphate reduces the coefficient of friction by at least 30% at 100° C. and preferably by at least 50% at 100° C. The amount of $C_2$ to $C_{12}$ aliphatic carboxylate salt of molybdenum should be about 0.25% to about 10% by weight of the lubricating composition. In one embodiment the mount of a 2-ethylhexanoic salt of molybdenum is about 0.25% to about 2% by weight. The mount of zinc dialkyldithiophosphate or zinc dialkyldithiocarbamate should be between about 0.5% to about 2% by weight of the lubricating composition. In one embodiment, the amount of zinc diisopropyldithiophosphate or zinc diisopropyldithiocarbamate should be about 0.65% to about 0.9% by weight. The ratio of a $C_2$ to $C_{12}$ aliphatic carboxylate salt of molybdenum and a zinc dialkyldithiophosphate should be about 1:3 to about 1:1 and preferably is about 1:1.5.

It may be advantageous to form concentrates of the additives when the additives are prepared in the same lubricating oil as will be used in making the final dilute lubricant composition. Such concentrates will contain from 10% to 60% by weight of oil and from 90% to 40 % by weight of at least one of the salts of the invention. The concentrates are then metered or otherwise dispensed in the amounts needed and mixed with the base lubricating composition to achieve the concentrations noted above. In an alternative embodiment, a mixed concentrate of the additives including both the aliphatic carboxylate salt of molybdenum and the zinc dialkyldithiophosphate is prepared in a suitable lubricating oil. This concentrate is added directly to engine oil already in the engine as an oil supplement in an amount to achieve the final dilute lubricant composition. In this way the fuel economy benefits of the present invention can be achieved by the average consumer without having to undertake an expensive and often messy oil change.

One aspect of the present invention that should be appreciated by one of ordinary skill in the art is the significant reduction in the coefficient of friction realized at low or moderate engine temperatures. It is only through the synergistic combination of the aliphatic carboxylate salt of molybdenum and zinc dialkyldithiophosphate that this unexpected benefit is realized. Evidence of this synergistic effect is shown in FIG. 1 which is a graphical representation of data gathered by measuring the coefficient of friction of several lubricating compositions with respect to temperature. The specific formulations and method of measurement are described below in Example 1. What should be apparent to one skilled in the art is that an unexpected reduction in the coefficient of friction is realized at low and moderate temperatures by the lubricant compositions of the present invention. Further, this reduction in the coefficient of friction is not a simple combination of the known beneficial properties of each additive. Instead, it is result of the unexpected synergistic interaction of the aliphatic carboxylate salt of molybdenum and zinc dialkyldithiophosphate or zinc dialkyldithiocarbamate.

Without intending to be limited to any particular theory regarding the synergistic interaction of the aliphatic carboxylate salt of molybdenum and zinc dialkyldithiophosphate of the present invention, it is presently believed that it is a ligand exchange reaction that generates the unexpected synergistic results observed.

Figure 2:
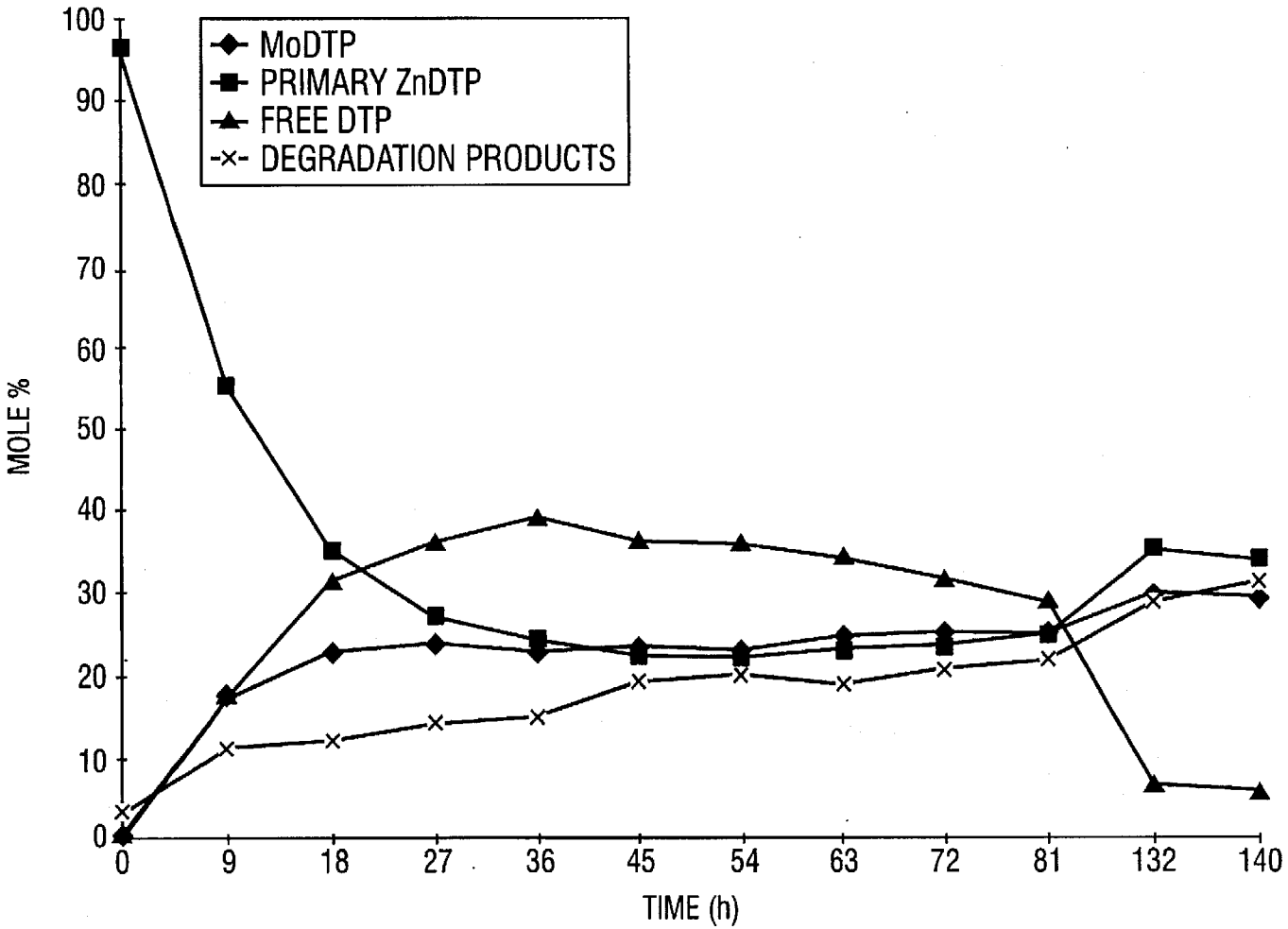
FIG. 2 is a graphical representation of data showing the relative concentrations of the species formed in a solution containing the 2-ethylhexanoic acid salt of molybdenum and the zinc diisopropyldithiophoshphate at 100° C. over time.

Support for the above belief and proposed theory of interaction is based on spectroscopic studies. In particular, $^{31}P$ nuclear magnetic resonance (NMR) spectroscopic studies of a mixture of the 2-ethylhexanoate salt of molybdenum and zinc diisopropyldithiophosphate in a non-polar hydrocarbon ($d_8$-toluene) were conducted at 100° C. Based on the integrated values of the peaks corresponding to each specie in solution, a plot of relative concentration (Mole % P) versus time (hours) was prepared and is presented in FIG. 2. With reference to FIG. 2, at the starting point, (time=0 hours), the principle specie in solution is zinc diisopropyldithiophosphate. After 40 hours, over ¾ of the zinc diisopropyldithiophosphate has dissociated forming an unbound or "free" diisopropyldithiophosphate ion in solution and a molybdenum diisopropyldithiophosphate specie. The final solution, after 140 hours, contains an approximately equal concentrations of zinc diisopropyldithiophosphate specie and molybdenum diisopropyldithiophosphate specie and a relatively low concentration of free diisopropyldithiophosphate. Like many ligand exchange reactions that occur at elevated temperatures, uncharacterized products form in the solution.

Figure 3:
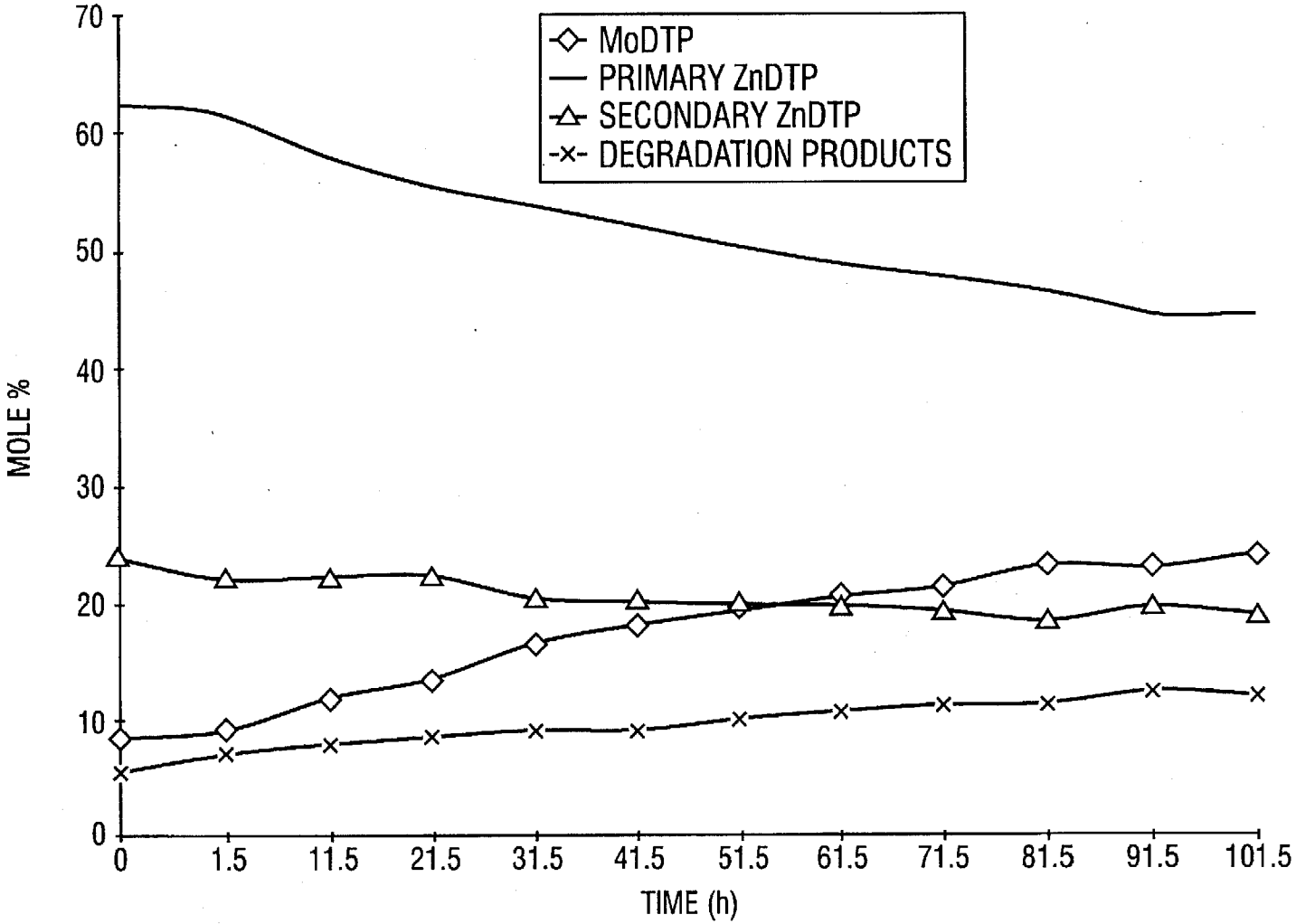
FIG. 3 is a graphical representation of data showing the relative concentrations of the species formed in a solution containing the 2-ethylhexanoic acid salt of molybdenum and the zinc didecyldithiophoshphate at 100° C. over time.

It has also been observed that a longer alkyl ligand exchanges at a much slower rate than shorter alkyl ligands. The above spectroscopic study was repeated using zinc diisodecyldithiophosphate in place of zinc diisopropyldithiophospahte. A plot of relative concentrations (mole % P) versus time (hours) was prepared and is presented in FIG. 3. With reference to FIG. 3, one skilled in the art should note that any given time the relative amount of zinc diisodecyldithiophosphate starting material is higher when compared to the relative mount of zinc diisopropyldithiophospate as shown in FIG. 2. Further the relative concentrations of unbound diisodecyldithiophosphate and the molybdenum didecyldithiophosphate at any given time are much lower than those of the diisopropyldithiophospate and molybdenum diisopropyldithiophosphate at the same time. Thus one skilled in the art should realize that this difference is likely due to the change in alkyl group. Further, one skilled in the art will realize that this difference indicates that the diisodecyldithiophosphate exchanges at a slower rate than the diisopropyldithiophospate ligand.

One skilled in the art will appreciate that the time frame of the above study is much longer than that used to determine the coefficient of friction. However, it should also be appreciated that it is the bulk temperature of the oil that is measured during the coefficient of friction determination and that the actual temperature at the points of frictional contact will be much higher than 100° C. Thus one should appreciate that the kinetics of the above reaction would be enhanced well above what is shown above. For example, it is a well known "rule of thumb" that the rate of a reaction is increased by a factor of 2 for every 10° K or in this case 10° C. increase in the temperature. Thus one of ordinary skill in the art would know and appreciate that the rate of reaction shown in the above experiment would be much faster under actual friction test conditions or conditions encountered in an engine operating at temperatures reaching 150° C.

The experiments and data are presented above in support of the belief and theory of interaction, that it is the interaction of the aliphatic carboxylate salt of molybdenum and zinc dialkyldithiophosphate, that generates the unexpected synergistic results observed. Regardless of the actual mechanism of action, it is the combination and unexpected result of a reduced coefficient of friction and increased fuel economy achieved that is one of the unique aspects of the embodiments of what is disclosed herein.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE 1

Formulation of Oil Compositions

Lubricating compositions used were SAE 10–30W blends containing conventional 98–100 VI mineral oil with an API "SG" additive package including a mixed calcium phenate and overbased calcium sulfonate detergent system, a PIB-succinimide dispersant and an amine antioxidant. The VI improver was a dispersant/antioxidant type based on an ethylene/propylene copolymer backbone. Additive compounds were blended into this "base oil" using conventional techniques so as to achieve the compositions noted below.

Determination of the Coefficient of Friction

The coefficient of friction of the oil compositions were under "boundary" lubrication conditions using Cameron-Plint Reciprocating Friction Test Equipment using the following procedure. A sample of oil was placed in the sample cup. Under a constant load and sliding amplitude, the sample was heated from room temperature to 165° C. Prior to raising the temperature to 165° C., a 10 minute "wear-in" period of the metal surfaces was conducted for each sample at 50° C., 5 Hz sliding speed, and 50N load, a 100N load was applied and the temperature was then raised to 165° C. over a 50 minute period. During this period, the stroke frequency was held constant and the load was maintained at 100N. The coefficient of friction was calculated by dividing the frictional force observed by the 100N load for each sample.

Representative data from the above measurements are given below in Table 1 comparing a base oil including a mixture zinc dialkyldithiophosphate (ZnDTP), primarily zinc diisopropyldithiophophate but also minor amounts of the $C_6$ and $C_7$dialkyls, a base oil including molybdenum 2-ethylhexanoate (MoHEX), and a base oil including both zinc dialkyldithiophosphate (ZnDTP) and molybdenum 2-ethylhexanoate (MoHEX) in accordance with the present invention. The data is also shown in graphical form in FIG. 1.

TABLE 1

| | | Coefficient of Friction at (°C.) | | | | |
|---|---|---|---|---|---|---|
| Additive | % weight | 60 | 80 | 100 | 120 | 150 |
| ZnDTP | 1.34 | 0.14 | 0.15 | 0.16 | 0.16 | 0.16 |
| MoHEX | 1 | 0.16 | 0.16 | 0.17 | 0.17 | 0.18 |
| ZnDTP | 1.34 | 0.06 | 0.08 | 0.11 | 0.11 | 0.11 |
| MoHEX | 1.0 | | | | | |
| Base Oil | n/a | 0.2 | 0.17 | 0.17 | 0.17 | 0.17 |

Given the above information, one of ordinary skill in the art should readily appreciate that the reduction in the coefficient of friction observed is the result of a synergistic interaction between the molybdenum 2-ethylhexanoate and the zinc dialkyldithiophosphate. Further, it will be realized that this synergistic interaction occurs at low to moderate temperatures resulting in less friction at these temperatures and a substantial increase in the fuel economy characteristics of the lubricating composition.

EXAMPLE 2

Lubricating compositions were formulated and the coefficient of friction was determined as previously noted above in Example 1. Representative data from these measurements are given below in Table 2 comparing a base oil containing molybdenum dialkyldithiocarbamate (MoDTC) in which the alkyl groups are primarily isopropyl but also minor amounts of the $C_6$ and $C_7$ dialkyls, the base oil containing only molybdenum 2-ethylhexanoate, and the base oil containing both ZnDTP and molybdenum 2-ethylhexanoate in accordance with the present invention.

TABLE 2

| | | Coefficient of Friction at (°C.) | | | | |
|---|---|---|---|---|---|---|
| Additive | % weight | 60 | 80 | 100 | 120 | 150 |
| MoDTC | 1 | 0.12 | 0.12 | 0.12 | 0.09 | 0.05 |
| MoHEX | 1 | 0.16 | 0.16 | 0.17 | 0.17 | 0.19 |

TABLE 2-continued

| | | Coefficient of Friction at (°C.) | | | | |
|---|---|---|---|---|---|---|
| Additive | % weight | 60 | 80 | 100 | 120 | 150 |
| ZnDTP | 1.34 | 0.06 | 0.08 | 0.11 | 0.11 | 0.11 |
| MoHEX | 1 | | | | | |
| ZnDTC | 1 | 0.14 | 0.14 | 0.13 | 0.10 | 0.08 |
| MoHEX | 1 | | | | | |

Given the above data, one of ordinary skill in the art should appreciate that the combination of ZnDTC and MoHEX has a comparable synergistic effect as ZnDTP and MoHEX in reducing the coefficient of friction. Further it should be recognized that the synergistic interaction occurs at a relatively low temperture.

EXAMPLE 3

Lubricating compositions were formulated and the coefficient of friction was determined as previously noted above in Example 1. A portion of a lubricating composition containing both zinc dialkyldithiophosphate (ZnDTP) and molybdenum 2-ethylhexanoate (MoHEX) was heated to a temperature of about 140° C. for about 2 hours. After cooling to room temperature, the coefficient of friction of the heat treated sample was determined. Representative data comparing the un-heated sample to the heat treated sample are given below in Table 3.

TABLE 3

| | Coefficient of Friction at (°C.) | | | | |
|---|---|---|---|---|---|
| Pre-Treatment | 60 | 80 | 100 | 120 | 150 |
| Unheated | 0.06 | 0.08 | 0.11 | 0.11 | 0.11 |
| Heated 140° C., 2 hours | 0.11 | 0.09 | 0.08 | 0.09 | 0.08 |
| Heated 150° C., 2 hours | 0.04 | 0.04 | 0.05 | 0.06 | 0.06 |

Given the above data, one of ordinary skill in the art should appreciate that the lubricating compositions of the present invention significantly reduce the coefficient of friction even after being heated to high temperature. This implies that the synergistic interaction between the (ZnDTP) and the MoHEX at high temperature (140° C.) forms a lubricating composition that significantly, reduces friction. Further the above results show that once formed, the lubricating composition of the present invention significantly reduces the coefficient of friction even at low temperature which previously has not been achieved.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A method of improving the fuel economy characteristics of a lubricant by friction reduction, comprising mixing the lubricant with a $C_2$ to $C_{12}$ aliphatic carboxylate salt of molybdenum and a zinc dialkyldithiophosphate wherein the alkyl group of the zinc dialkyldithiophosphate is selected so that the zinc dialkyldithiophosphate exchanges ligands with the aliphatic carboxylate salt of molybdenum.

2. The method of claim 1 wherein the alkyl group of the zinc dialkyldithiophosphate is a $C_2$ to $C_8$ aliphatic hydrocarbon.

3. The method of claim 2 wherein the mount of aliphatic carboxylate salt of molybdenum is between 0.25% and 10% by weight.

4. The method of claim 2 wherein the aliphatic carboxylate of the aliphatic carboxylate salt of molybdenum is 2-ethylhexanoate.

5. The method of claim 4 wherein the alkyl group of the zinc dialkyldithiophosphate is isopropyl, $C_6$ alkyl, $C_7$ alkyl and mixtures thereof.

6. The method of claim 3 wherein the mount of zinc dialkyldithiophosphate is between 0.5% and 2.0% by weight.

7. The method of claim 1 wherein the mount of aliphatic carboxylate salt of molybdenum and the amount of zinc dialkyldithiophosphate reduce the coeficient of friction by at least 30% at 100° C.

8. The method of claim 1 wherein the ratio of the aliphatic carboxylate salt of molybdenum to the zinc dialkyldithiophosphate is between 1:3 to 1: 1.

9. A lubricating oil composition comprising a major amount of an oil of lubricating viscosity and minor amounts of an aliphatic carboxylate salt of molybdenum and a zinc dialkyldithiophosphate wherein the alkyl group of the zinc dialkyldithiophosphate is selected so that the zinc dialkyldithiophosphate exchanges ligands with the aliphatic carboxylate salt of molybdenum and wherein the alkyl group of the zinc dialkyldithiophosphate is a $C_7$ to $C_8$ aliphatic hydrocarbon.

10. The composition of claim 9 wherein the mount of aliphatic carboxylate salt of molybdenum is between 0.25% and 10% by weight.

11. The composition of claim 9 wherein the aliphatic carboxylate of the aliphatic carboxylate salt of molybdenum is 2-ethylhexanoate.

12. The composition of claim 11 wherein the alkyl group of the zinc dialkyldithiophosphate is isopropyl, $C_6$ alkyl, $C_7$ alkyl and mixtures thereof.

13. The composition of claim 10 wherein the amount of zinc dialkyldithiophosphate is between 0.5% and 2.0% by weight.

14. The composition of claim 9 wherein the amount of aliphatic carboxylate salt of molybdenum and the amount of zinc dialkyldithiophosphate reduce the coefficient of friction by at least 30% at 100° C.

15. The composition of claim 9 wherein the ratio of the aliphatic carboxylate salt of molybdenum to the zinc dialkyldithiophosphate is between 1:3 to 1:1.

16. A lubricating oil composition comprising a major amount of an oil of lubricating viscosity and minor amounts of an aliphatic carboxylate salt of molybdenum and a zinc dialkyldithiocarbamate wherein the alkyl group of the zinc dialkyldithiocarbamate is selected so that the zinc dialkyldithiocarbamate exchanges ligands with the aliphatic carboxylate salt of molybdenum and wherein the amount of aliphatic carboxylate salt of molybdenum and the amount of zinc dialkyldithiocarbamate reduce the coefficient of friction by at least 30% at 100° C.

17. The composition of claim 16 wherein the alkyl group of the zinc dialkyldithiocarbamate is a $C_2$ to $C_8$ aliphatic hydrocarbon.

18. The composition of claim 17, wherein the amount of aliphatic carboxylate salt of molybdenum is between 0.25% and 10% by weight.

19. The composition of claim 17, wherein the aliphatic carboxylate of the aliphatic carboxylate salt of molybdenum is 2-ethylhexanoate.

20. The composition of claim 19 wherein the alkyl group of the zinc dialkyldithiocarbamate is isopropyl, $C_6$ alkyl, $C_7$ alkyl and mixtures thereof.

21. The composition of claim 18 wherein the amount of zinc dialkyldithiocarbamate is between 0.5% and 2.0% by weight.

22. The composition of claim 16 wherein the ratio of the aliphatic carboxylate salt of molybdenum to the zinc dialkyldithiocarbamate is between 1:3 to 1:1.

* * * * *

UNITED STATES PATENT AND TRADEMARK OFFICE

CERTIFICATE OF CORRECTION

PATENT NO. : 5,736,491

DATED : April 7, 1998

INVENTOR(S) : Jitendra A. Patel et al.

It is certified that error appears in the above-identified patent and that said Letters Patent is hereby corrected as shown below:

Column 1, line 61, "the use of a additive" should be "the use of an additive"

Column 3, line 14, "invention readily" should be "invention are readily"

Column 4, lines 44, 55, and 57, the word "mount" should be "amount"

Column 6, lines 3, 9, 12, and 18, the words "diisopropyldithiophospahte" and "diisopropyldithiophospate" should be "diisopropyldithiophosphate Column 9, lines 4, 13, 16, and 32, the word "mount" should be "amount"

Column 9, line 22, the comparison "1: 1" should be without a space like "1:1"

Column 9, line 30, the "$C_7$" should be "$C_2$"

Signed and Sealed this

Twenty-ninth Day of December, 1998

*Attest:*

Bruce Lehman

BRUCE LEHMAN

*Attesting Officer*

*Commissioner of Patents and Trademarks*